US007017839B2

(12) United States Patent
Heyse

(10) Patent No.: US 7,017,839 B2
(45) Date of Patent: Mar. 28, 2006

(54) FUEL INJECTION VALVE

(75) Inventor: Jörg Heyse, Besigheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/333,375

(22) PCT Filed: May 7, 2002

(86) PCT No.: PCT/DE02/01630

§ 371 (c)(1),
(2), (4) Date: Aug. 20, 2003

(87) PCT Pub. No.: WO02/097262

PCT Pub. Date: Dec. 5, 2002

(65) Prior Publication Data

US 2004/0026538 A1 Feb. 12, 2004

(30) Foreign Application Priority Data

May 16, 2001 (DE) ..... 101 23 859

(51) Int. Cl.
*F02M 61/00* (2006.01)

(52) U.S. Cl. ..... 239/533.12; 239/533.14; 239/533.2; 239/596; 239/585.1

(58) Field of Classification Search ..... 239/533.12, 239/533.14, 533.2, 533.3, 533.5, 533.7, 596, 239/585.1, 585.4, 585.5
See application file for complete search history.

(56) References Cited

U.S. PATENT DOCUMENTS

| | | | | |
|---|---|---|---|---|
| 4,650,122 | A * | 3/1987 | Kienzle et al. | 239/497 |
| 5,645,225 | A * | 7/1997 | Hasegawa et al. | 239/533.12 |
| 5,984,211 | A | 11/1999 | Sugimoto et al. | |
| 6,186,418 | B1 | 2/2001 | Tani | |

FOREIGN PATENT DOCUMENTS

| | | |
|---|---|---|
| DE | 30 12 416 | 10/1981 |
| DE | 196 42 513 | 4/1998 |
| DE | 198 27 219 | 1/1999 |
| DE | 198 04 463 | 8/1999 |
| FR | 2 352 957 | 12/1977 |
| GB | 1 214 595 | 12/1970 |
| JP | 9 14086 | 1/1997 |

* cited by examiner

*Primary Examiner*—Dinh Q. Nguyen
(74) *Attorney, Agent, or Firm*—Kenyon & Kenyon

(57) ABSTRACT

A fuel injector, in particular for the direct injection of fuel into a combustion chamber of an internal combustion engine, includes a valve needle at whose discharge-side end a valve-closure member is positioned, which cooperates with a valve-seat surface, formed at a valve-seat member, to form a sealing seat. A spray-discharge orifice calotte connected to the valve-seat member of the fuel injector, or integrally formed in one piece with it, has at least three spray-discharge orifices not all extended axes of the spray-discharge orifices intersecting.

10 Claims, 2 Drawing Sheets

FUEL INJECTION VALVE

BACKGROUND INFORMATION

From German Patent Application No. DE 198 27 219, a fuel injection system for an internal combustion engine is known, which includes an injector that has a disk for adjusting the fuel jet, this disk including first nozzle orifices disposed along a first circle, and including second nozzle orifices disposed along a second circle. The second circle has a larger diameter than the first circle. The circles are positioned coaxially with respect to a center axis of the adjustment disk. Each orifice axis of the second nozzle orifices forms an acute angle to a reference plane that is perpendicular to the center axis of the valve body. The angle is smaller than that formed by each orifice axis of the first nozzle orifices with the reference plane. Therefore, fuel atomizations, which are injected through the first nozzle orifices, can be directed away from the fuel atomizations being injected through the second nozzle orifices. As a result, the fuel atomizations injected through the first nozzle orifices do not interfere with the fuel atomizations injected through the second nozzle orifices, thereby allowing an appropriate atomization of the injected fuel.

Disadvantageous in this related art is that, on an inflow-side of the disk for adjusting the fuel jet, the spacing of the nozzle orifices is smaller than it is on an outer side of the disk for adjusting the fuel jet facing away from a combustion chamber. As a result, the formation of an overall injection jet, made up of the individual fuel jets, is only possible in certain (setpoint) inputs. The spacing of the nozzle orifices must not fall below certain values if the stability and strength of the disk for adjusting the fuel are to be ensured.

From German Patent Application No. DE 198 04 463, a fuel injector for mixture-compressing internal combustion engines having external ignition is known, which is provided with at least one row of injection orifices distributed over the circumference of the injection nozzle. Fuel is selectively injected via the injection orifices to realize a jet-controlled combustion method by a mixture cloud being formed, at least one jet being aimed in the direction of the spark plug or its immediate vicinity for the ignition. Additional jets are provided for forming an at least approximately continuous or cohesive mixture cloud.

In this related art, the injection orifices with their extended axes on the side of the fuel inflow, are directed to a common intersection of the axes. An optimal strength of the spray-discharge section, which is penetrated by the injection orifices, cannot be achieved.

SUMMARY OF THE INVENTION

The fuel injection system according to the present invention, has the advantage over the related art that the spray-discharge orifices are evenly distributed over the surface of the spray-discharge orifice calotte. Even on the side of the spray-discharge orifice calotte facing the valve needle, there are no spaces between the spray-discharge orifices that are too narrow. The strength of the spray-discharge orifice calotte is at its maximum.

The spray-discharge orifices are advantageously configured on the spray-discharge orifice calotte in a way that maximizes the average respective clearances of adjacent axes.

Bores placed in a flat disk have a maximum mutual clearance when they are evenly distributed over the disk and when the extended axes of adjacent bores are in parallel to one another. In fuel injectors, however, the spray-discharge orifices are disposed on an essentially hemispherical spray-discharge orifice calotte. Moreover, the spray-discharge orifices must be aligned in such a way that the desired jet pattern is generated. Therefore, the axes of the spray-discharge orifices are not in parallel to one another. The alignment is implemented in that all the axes of the spray-discharge orifices intersect at one point on the side of the valve needle to the spray-discharge orifice calotte, and the location of the spray-discharge orifice on the spray-discharge orifice calotte determines the direction of the axis. When the spray-discharge orifices are moved further apart, so that the axes of adjacent spray-discharge orifices have the largest possible clearance when viewed as geometrical lines in space, a maximum strength of the spray-discharge orifice calotte is able to be obtained. Since the orientation of a spray-discharge orifice is then, up to a certain extent, independent of the location of the spray-discharge orifice on the spray-discharge orifice calotte, the spray-discharge orifices may be distributed evenly on the spray-discharge orifice calotte in an advantageous manner. The faults in the formation of a total jet pattern, made up of individual fuel jets of the spray-discharge orifices, which are caused by the spray-discharge orifices being moved further apart, are negligible.

In one advantageous specific embodiment, the maximally two axes in each case intersect, and the intersecting points of the intersecting axes lie on a plane of symmetry that is perpendicular to the plane of the spray-discharge calotte. The spray-discharge orifices whose axes intersect are disposed in mirror symmetry with respect to the plane of symmetry and are oriented such that an ellipse results in a jet cross-section across all fuel jets of the spray-discharge orifices.

It is advantageously possible to generate a jet cross-section which, in the overall jet pattern, has an elliptical form across all fuel jets, without all spray-discharge orifices being configured on a narrowly restricted, essentially elliptical segment of the surface of the spray-discharge orifice calotte. The spray-discharge orifices may be evenly distributed across the spray-discharge orifice calotte.

In another advantageous specific embodiment, the spray-discharge orifices are arranged in an essentially circular manner about an axis of symmetry of the spray-discharge orifice calotte. The axes of the spray-discharge orifices are then tangential to a cylinder around the axis of symmetry, and the fuel jets essentially form a cone at a certain distance from the spray-discharge orifice calotte.

This advantageous specific embodiment as well, has the advantage over the related art of a substantially stronger spray-discharge orifice calotte.

DETAILED DESCRIPTION

Figure 1:
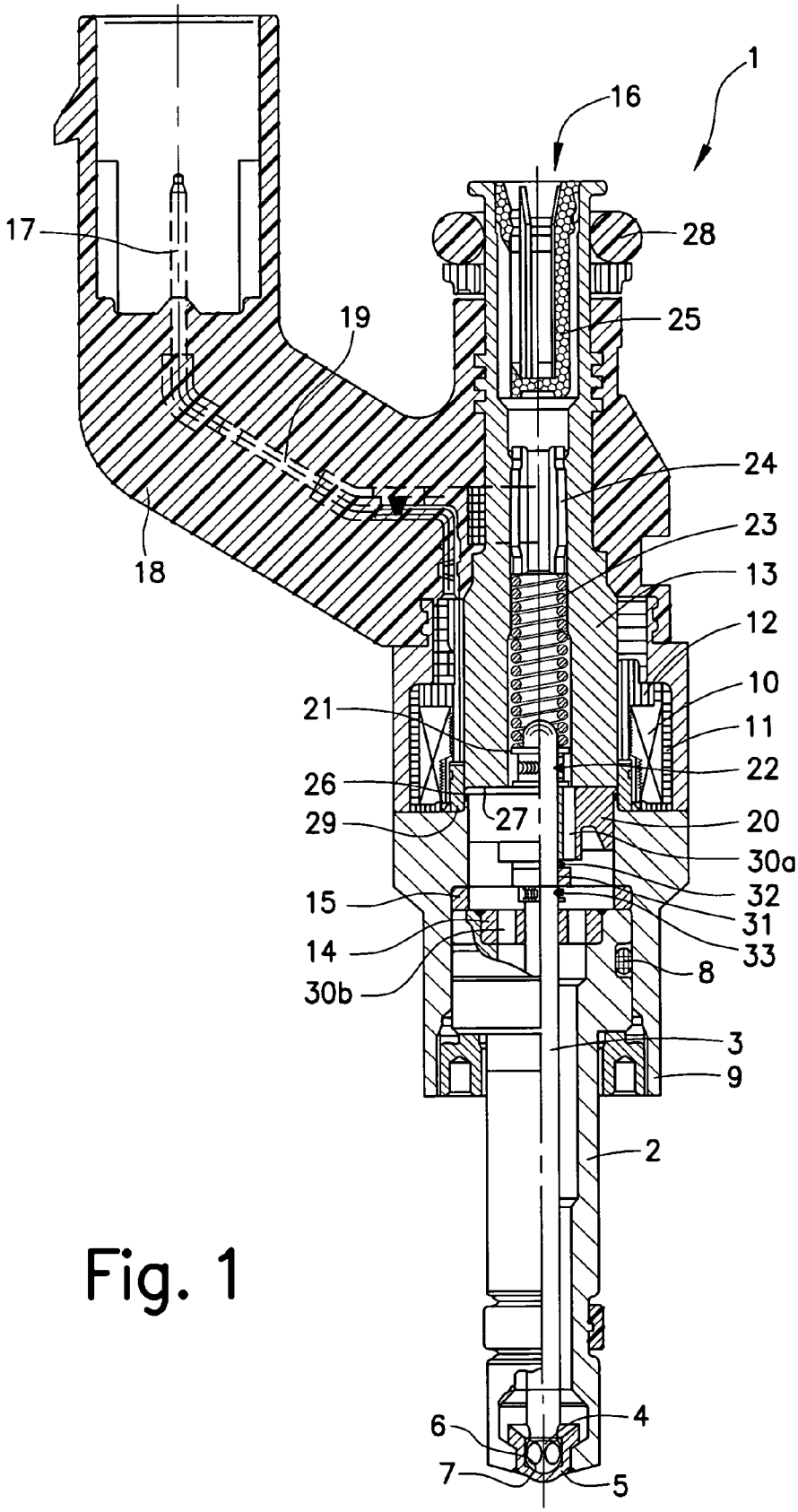
FIG. 1 shows a schematic section through a first exemplary embodiment of a fuel injector, designed according to the present invention.

A first exemplary embodiment of a fuel injector 1 according to the present invention is designed in the form of a fuel injector 1 of a fuel injection system for mixture-compressing internal combustion engines having externally supplied ignition. Fuel injector 1 is particularly suited for the direct injection of fuel into a combustion chamber (not shown) of an internal combustion engine.

Fuel injector 1 is made up of a nozzle body 2 in which a valve needle 3 is positioned. Valve needle 3 is mechanically linked to a valve-closure member 4, which interacts with a valve-seat surface 6 positioned on a valve-seat member 5, to form a sealing seat. In the exemplary embodiment, fuel injector 1 is an inwardly opening fuel injector 1, which has a plurality of spray-discharge orifices 7. Seal 8 seals nozzle body 2 from an outer pole 9 of a magnetic coil 10. Magnetic coil 10 is encapsulated in a coil housing 11 and wound on a coil brace 12, which rests against an inner pole 13 of magnetic coil 10. Inner pole 13 and outer pole 9 are separated from each other by a constriction 26 and are interconnected by a non-ferromagnetic connecting part 29. Magnetic coil 10 is energized via a line 19 by an electric current, which may be supplied via an electrical plug contact 17. A plastic coating 18, which may be extruded onto inner pole 13, encloses plug contact 17.

Valve needle 3 is guided in a valve-needle guide 14, which is disk-shaped. A paired adjustment disk 15 is used to adjust the (valve) lift. An armature 20 is on the other side of adjustment disk 15. It is connected by force-locking to valve needle 3 via a first flange 21; and valve needle 3 is connected to first flange 21 by a welded seam 22. Braced against first flange 21 is a restoring spring 23 which, in the present design of fuel injector 1, is prestressed by a sleeve 24. Fuel channels 30*a* through 30*b* run in valve-needle guide 14, in armature 20 and valve-seat member 5. The fuel is supplied via a central fuel feed 16 and filtered by a filter element 25. Fuel injector 1 is sealed from a distributor line (not shown further) by a gasket 28.

On the spray-discharge side of armature 20 is a ring-shaped damping element 32 made of an elastomeric material. It rests on a second flange 31, which is connected by force-locking to valve needle 3 via a welded seam 33.

In the rest state of fuel injector 1, armature 20 is acted upon by restoring spring 23, in a direction opposite to its lift direction, in such a manner that valve-closure member 4 is sealingly held against valve seat 6. In response to excitation of magnetic coil 10, it generates a magnetic field which moves armature 20 in the lift direction, counter to the spring force of restoring spring 23, the lift being predefined by a working gap 27, which occurs in the rest position between inner pole 12 and armature 20. First flange 21, which is welded to valve needle 3, is also taken along by armature 20 in the lift direction. Valve-closure member 4, which is connected to valve needle 3, lifts off from valve seat surface 6, so that the fuel is spray-discharged through spray-discharge openings 7.

In response to interruption of the coil current, following sufficient decay of the magnetic field, armature 20 falls away from inner pole 13 due to the pressure of restoring spring 23, whereupon first flange 21, being connected to valve needle 3, moves in a direction counter to the lift. Valve needle 3 is thereby moved in the same direction, causing valve-closure member 4 to set down on valve seat surface 6 and fuel injector 1 to be closed.

Figure 2A:
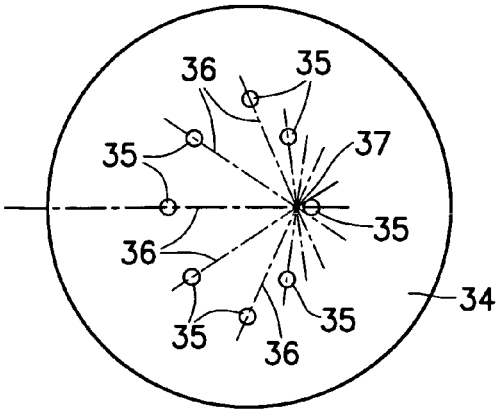
Fig. 2a Related Art
FIG. 2*a* shows a spray-discharge orifice calotte in a plan view, according to the related art, for an overall jet pattern having an elliptical cross-section, in a plan view from the direction of the fuel injector.

FIG. 2*a* shows a plan view of spray-discharge orifice calotte 34 according to the related art, for an overall jet pattern having an elliptical cross-section. The view corresponds to the view from fuel injector 1 into the inside of the curvature of spray-discharge orifice calotte 34. Spray-discharge orifices 35 are disposed approximately on a plane enclosed by an ellipse, and axes 36, defined by the orientation of spray-discharge orifices 35, intersect at an intersection 37.

Figure 2B:
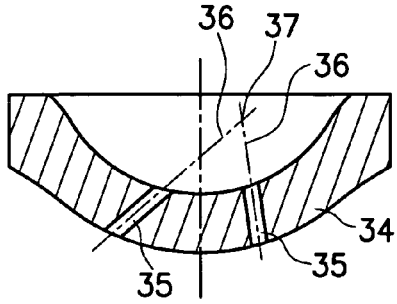
Fig. 2b Related Art
FIG. 2*b* shows a cross-section through the spray-discharge orifice calotte of FIG. 2*a*.

FIG. 2*b* shows a cross-section through spray-discharge orifice calotte 34 in FIG. 2*a*, which includes spray-discharge orifices 35, axes 36 and intersection 37.

As can be seen very clearly, spray-discharge orifices 35 must be arrayed in relatively close proximity to one another, so as to generate, due to their orientation, an overall jet pattern that has an elliptical cross-section. Especially on the upper side, facing fuel injector 1, of spray-discharge orifice calotte 34, spray-discharge orifices 35 come very close to one another. However, for reasons of production engineering, a minimum clearance of one spray-discharge orifice diameter must be observed.

Figure 3A:
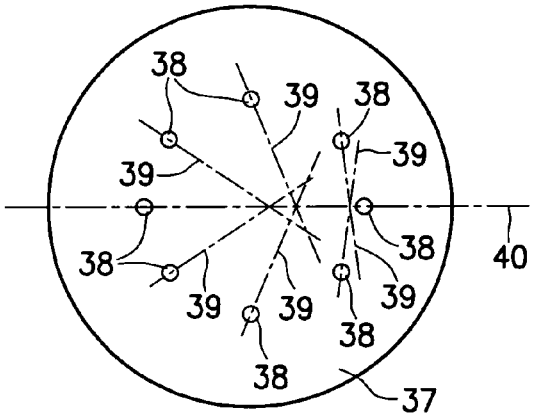
FIG. 3*a* shows a first variant of a spray-discharge orifice calotte, designed according to the present invention, in a plan view, for an overall jet pattern having an elliptical cross-section.

In a plan view from the direction of valve-closure member 4 of fuel injector 1 of FIG. 1, FIG. 3*a* shows a first exemplary embodiment of a spray-discharge orifice calotte 37, designed according to the present invention, for an overall jet pattern that has an elliptical cross-section. Spray-discharge orifice calotte 37 is designed in one piece, together with valve-seat member 5 of FIG. 1. The view corresponds to the inside view of the curvature of spray-discharge orifice calotte 37. Spray-discharge orifices 38 are approximately evenly distributed in spray-discharge orifice calotte 37. Axes 39, defined by the orientation of spray-discharge orifices 38, intersect as a pair in each case in a plane of symmetry 40, which is perpendicular to the plane of spray-discharge orifice calotte 37, when viewed from the drawing plane.

Figure 3B:
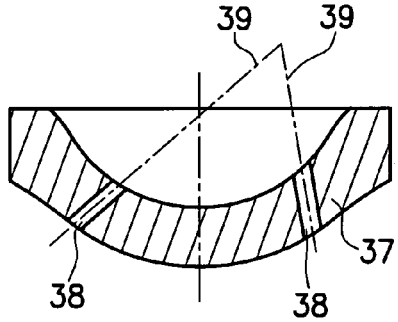
FIG. 3*b* shows a cross-section through the spray-discharge orifice calotte of FIG. 3*a*.

FIG. 3*b* shows a cross-section through spray-discharge orifice calotte 37 in FIG. 3*a*, which includes spray-discharge orifices 38 and axes 39 in the plane of symmetry 40 of FIG. 3*a*.

The advantageous configuration (array) and orientation of spray-discharge orifices 38 makes it possible to increase the strength of spray-discharge orifice calotte 37. Spray-discharge orifices 38 are evenly distributed and have a greater mutual clearance, particularly on the inside of spray-discharge orifice calotte 37. In contrast, errors in the overall jet pattern resulting from a shift in spray-discharge orifices 38 are negligible when working with an overall injection jet in close proximity to spray-discharge orifice calotte 37.

Figure 4:
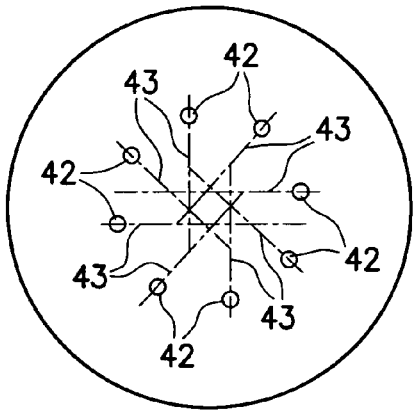
FIG. 4 shows an additional variant of a spray-discharge orifice calotte, designed according to the present invention, for a conical overall jet pattern, in a plan view.

In a plan view corresponding to the view of FIG. 3*a*, FIG. 4 shows another variant of a spray-discharge orifice calotte 41 for a conical overall jet pattern. Spray-discharge orifice calotte 41 has spray-discharge orifices 42 configured in an approximately circular manner. Axes 43, defined by the orientation of spray-discharge orifices 42, are tangential to the middle of an imaginary cylinder.

In this way, the same previously described advantages are obtained for a conical overall jet pattern. In particular, one may specify an alignment of the jet cone's center axis, relative to a fuel-injector axis, of 0°–70° for the conical jet, as well as an opening angle of 30°–100°. In addition, spray-discharge orifices 42 must not necessarily be configured in a graduated circle, but may also be evenly distributed in the form of a raster.

The present invention is not limited to the described exemplary embodiments and y also be used, for example, to generate a hollow cone or a fan jet.

What is claimed is:

1. A fuel injector comprising:

a valve-seat member;

a valve seat surface formed at the valve-seat member;

a valve needle having a discharge-side end and including a valve-closure member situated at the discharge-side end, the valve-closure member cooperating with the valve-seat surface to form a sealing seat; and a spray-discharge orifice calotte which is one of (a) connected to the valve-seat member and (b) integrally formed in one piece with the valve-seat member, the spray-discharge orifice calotte having at least three spray-discharge orifices, the spray-discharge orifices having extended axes, not all of the extended axes of the spray-discharge orifices intersecting, wherein at most two axes intersect in each case.

2. The fuel injector according to claim 1, wherein the fuel injector is for the direct injection of fuel into a combustion chamber of an internal combustion engine.

3. The fuel injector according to claim 1, wherein the orifices are configured and oriented on the calotte such that respective average clearances of adjacent axes are maximal.

4. The fuel injector according to claim 1, wherein points of intersection of the intersecting axes lie on an axis of symmetry that is perpendicular to a plane of the calotte.

5. The fuel injector according to claim 4, wherein the orifices whose axes intersect are disposed in mirror symmetry with respect to a plane of symmetry.

6. The fuel injector according to claim 5, wherein the orifices are oriented such that an ellipse results in a cross-section of an overall jet pattern across fuel jets of the orifices.

7. The fuel injector according to claim 1, wherein the orifices are arrayed in the form of a raster.

8. The fuel injector according to claim 1, wherein the orifices are arrayed about an axis of symmetry of the calotte in a substantially circular manner.

9. The fuel injector according to claim 8, wherein axes of the orifices are tangential to a cylinder, about the axis of symmetry.

10. The fuel injector according to claim 8, wherein, at a distance from the calotte, fuel jets of the orifices substantially form a cone as an overall jet pattern across all fuel jets.

* * * * *

UNITED STATES PATENT AND TRADEMARK OFFICE

CERTIFICATE OF CORRECTION

PATENT NO. : 7,017,839 B2
APPLICATION NO. : 10/333375
DATED : March 28, 2006
INVENTOR(S) : Jörg Heyse It is certified that error appears in the above-identified patent and that said Letters Patent is hereby corrected as shown below:

Column 5, line 2, change “and y also be used,” to --and may also be used,--

Signed and Sealed this

Fifth Day of December, 2006

JON W. DUDAS
*Director of the United States Patent and Trademark Office*